US009764561B2

(12) United States Patent
Burress et al.

(10) Patent No.: US 9,764,561 B2
(45) Date of Patent: Sep. 19, 2017

(54) SYSTEM AND METHOD FOR CLEARING WEAK AND MISSING INKJETS IN AN INKJET PRINTER

(75) Inventors: Edward F. Burress, West Linn, OR (US); Brent R. Jones, Sherwood, OR (US)

(73) Assignee: Xerox Corporation, Norwalk, CT (US)

( * ) Notice: Subject to any disclaimer, the term of this patent is extended or adjusted under 35 U.S.C. 154(b) by 997 days.

(21) Appl. No.: 13/439,515

(22) Filed: Apr. 4, 2012

(65) Prior Publication Data

US 2013/0265352 A1 Oct. 10, 2013

(51) Int. Cl.

| | |
|---|---|
| ***B41J 2/21*** | (2006.01) |
| ***B41J 2/045*** | (2006.01) |
| *B41J 2/165* | (2006.01) |

(52) U.S. Cl.

CPC ..... *B41J 2/2139* (2013.01); *B41J 2/04581* (2013.01); *B41J 2/04588* (2013.01); *B41J 2/16526* (2013.01); *B41J 2002/1657* (2013.01); *B41J 2002/16573* (2013.01)

(58) Field of Classification Search

CPC B41J 2/16526; B41J 2/04581; B41J 2/04588; B41J 2/0459; B41J 2/04591

USPC ..... 347/5, 9–14, 68, 75

See application file for complete search history.

(56) References Cited

U.S. PATENT DOCUMENTS

| | | | | |
|---|---|---|---|---|
| 5,424,766 | A | 6/1995 | Anderson | |
| 5,659,342 | A * | 8/1997 | Lund et al. | 347/35 |
| 5,798,773 | A | 8/1998 | Hiramatsu et al. | |
| 6,164,752 | A | 12/2000 | Schaefer et al. | |
| 6,276,773 | B1 * | 8/2001 | Takizawa | 347/10 |
| 6,286,923 | B1 | 9/2001 | Sugahara | |
| 6,293,645 | B1 | 9/2001 | Kim | |
| 7,165,824 | B2 | 1/2007 | Walmsley et al. | |
| 7,566,109 | B2 | 7/2009 | Shinkawa et al. | |
| 7,585,044 | B2 | 9/2009 | Williams et al. | |
| 7,628,466 | B2 | 12/2009 | Cellura et al. | |
| 7,784,899 | B2 | 8/2010 | Shimazaki | |
| 7,878,615 | B2 | 2/2011 | Reichelsheimer et al. | |
| 7,891,754 | B2 | 2/2011 | Nagamura et al. | |
| 7,992,957 | B2 | 8/2011 | Motoyama et al. | |
| 2002/0036667 | A1 * | 3/2002 | Shingyohuchi | 347/11 |
| 2004/0260803 | A1 | 12/2004 | Nakamura | |
| 2006/0114284 | A1 * | 6/2006 | Mizes et al. | 347/19 |
| 2006/0164450 | A1 * | 7/2006 | Hoisington et al. | 347/10 |
| 2009/0073208 | A1 * | 3/2009 | Komatsu et al. | 347/11 |
| 2009/0231375 | A1 * | 9/2009 | Folkins et al. | 347/14 |
| 2009/0289975 | A1 * | 11/2009 | Yoshida | 347/10 |
| 2009/0289998 | A1 * | 11/2009 | Tanaka et al. | 347/68 |

(Continued)

FOREIGN PATENT DOCUMENTS

| | | |
|---|---|---|
| EP | 1 038 677 A1 | 9/2000 |

*Primary Examiner* — Geoffrey Mruk
*Assistant Examiner* — Scott A Richmond
(74) *Attorney, Agent, or Firm* — Maginot, Moore & Beck, LLP

(57) ABSTRACT

An inkjet printer is operated to print an ink image and clear inkjets simultaneously. The inkjet printer delivers to a first inkjet in a printhead a first signal that ejects an ink drop from the first inkjet that corresponds to a pixel of an ink image stored in a memory of the printer and delivers to at least one other inkjet in the printhead a second signal that ejects an ink drop from the at least one other inkjet that does not correspond to a pixel of the ink image stored in the memory of the printer.

14 Claims, 6 Drawing Sheets

(56) References Cited

U.S. PATENT DOCUMENTS

| | | | | |
|---|---|---|---|---|
| 2009/0295854 | A1* | 12/2009 | Kawakami et al. | 347/10 |
| 2010/0053241 | A1* | 3/2010 | Chandu et al. | 347/9 |
| 2010/0245454 | A1* | 9/2010 | Ramakrishnan et al. | 347/19 |
| 2010/0328383 | A1* | 12/2010 | Yoshikawa et al. | 347/12 |
| 2011/0063348 | A1* | 3/2011 | Mita | 347/9 |

* cited by examiner

SYSTEM AND METHOD FOR CLEARING WEAK AND MISSING INKJETS IN AN INKJET PRINTER

TECHNICAL FIELD

This disclosure relates generally to devices that produce ink images on media, and more particularly, to devices that that eject ink from inkjets to form ink images.

BACKGROUND

Inkjet imaging devices eject liquid ink from printheads to form images on an image receiving surface. The printheads include a plurality of inkjets that are arranged in some type of array. Each inkjet has a thermal or piezoelectric actuator that is coupled to a printhead controller. The printhead controller generates firing signals that correspond to digital data for images. The frequency and amplitude of the firing signals correspond to the selective activation of the printhead actuators. The printhead actuators respond to the firing signals by expanding into an ink chamber to eject ink drops onto an image receiving member and form an ink image that corresponds to the digital image used to generate the firing signals.

Throughout the life cycle of these inkjet imaging devices, the image generating ability of the device requires evaluation and, if the images contain detectable errors, correction. Missing inkjets or weak inkjets exemplify printhead errors that affect ink image quality. A missing inkjet is an inkjet that does not eject an ink drop in response to a firing signal. A weak inkjet is an inkjet that responds intermittently to a firing signal or that responds by ejecting ink drops having a mass that is different than the ink drop mass corresponding to the characteristics of the firing signal for the inkjet. As used in this document, "inoperative inkjets" refers to inkjets that are either missing inkjets or weak inkjets. Systems and methods have been developed that can enable inoperative inkjets to recover the ability to respond to firing signals.

Current inkjet recovery methods involve the use of pressure producing components connected to one or more printheads. These components typically use air to pressurize an ink reservoir in a printhead. The pressure urges ink through the ink manifolds and ink chambers and a portion of this ink is released at the nozzles of the printhead. The pressurized flow of ink through the inkjet ejectors of a printhead can clear debris and/or air entrained in the ink from weak or missing inkjets. Once cleared, these recovered inkjets can be used to generate ink images. During the inkjet clearing process, the ink emitted from the nozzles of the inkjets are directed by a wiper to a drip bib mounted on the printhead and the drip bib directs the collected ink to an ink receptacle.

This type of clearing process presents a number of issues. For one, the pressure is applied to all of the inkjets in a printhead. Even if only one inkjet in a printhead is detected as being inoperative, all of the inkjets in the printhead are purged. Another issue is the emitted ink. Although some inkjet printers include components for filtering and recirculating the ink in the ink receptacle into an ink supply for a printhead, not all of the ink can be recovered and, thus, some ink is lost in the process. This clearing pressure forces ink to flow out of the jets without being ejected as occurs during ink image formation. Consequently, this clearing process consumes ink without providing an imaging benefit. Additionally, while the clearing process is being performed, the inkjets of a printhead cannot be used to print ink images because the wiper is positioned to a location opposite the printhead to remove the emitted ink from the face of the printhead. Since this position is in the path of the image receiving surface, the wiper and image receiving surface are mutually exclusive. Consequently, this type of inkjet maintenance procedure interferes with the productive use of the printer. Improving the ability to recover inkjets in inkjet printers without the presence of these issues is important.

SUMMARY

A method of inkjet printer operation enables inkjets to be recovered without hindering ink image printing. The method includes delivering to a first inkjet in the printhead a first signal configured to operate a piezoelectric actuator in the first inkjet, the first signal being configured to eject an ink drop from the first inkjet that corresponds to a pixel of a digital image stored in a memory of the printer, and delivering to at least one other inkjet in the printhead a second signal configured to operate a piezoelectric actuator in the at least one other inkjet, the second signal being different than the first signal and being further configured to operate the piezoelectric actuator to extend a diaphragm further into an ink chamber of the at least one other inkjet than the diaphragm extends in response to a signal configured for ink image printing.

An inkjet printer implements the method to enable inkjet recovery without hindering ink image printing. The printer includes a printhead having a plurality of inkjets, each inkjet having a piezoelectric actuator configured to eject an ink drop from a nozzle and pull ink from a manifold in the printhead, and a controller configured to deliver to a first inkjet in the printhead a first signal configured to operate the piezoelectric actuator in the first inkjet, the first signal being configured to eject an ink drop from the first inkjet that corresponds to a pixel of a digital image stored in a memory operatively connected to the controller and to deliver to at least one other inkjet in the printhead a second signal configured to operate the piezoelectric actuator in the at least one other inkjet, the second signal being different than the first signal and being further configured to operate the piezoelectric actuator to extend a diaphragm further into an ink chamber of the at least one other inkjet than the diaphragm extends in response to a signal configured for ink image printing.

BRIEF DESCRIPTION OF THE DRAWINGS

The foregoing aspects and other features of a system and method that enable inkjet recovery without hindering ink image printing are explained in the following description, taken in connection with the accompanying drawings.

DETAILED DESCRIPTION

Figure 1:
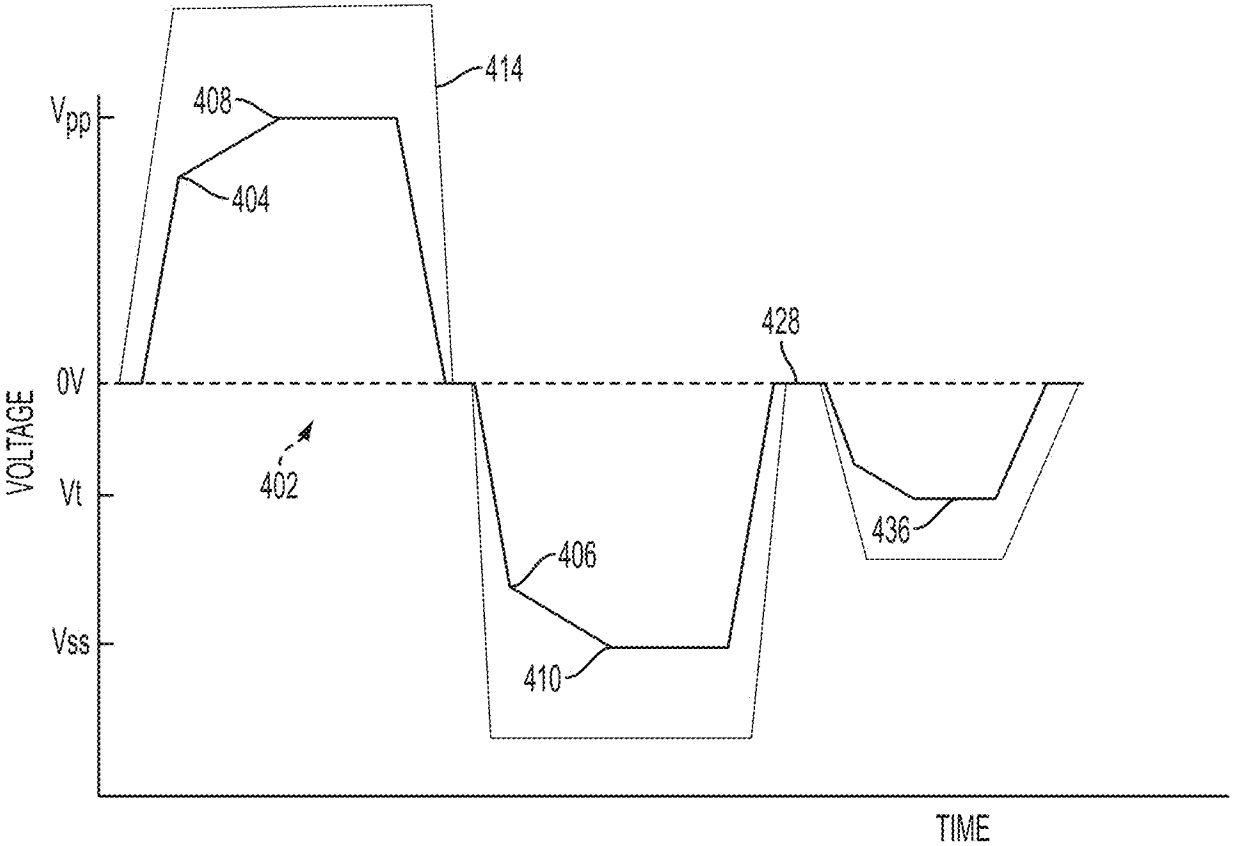
FIG. 1 is a graph of an example of a firing signal and a clearing signal.

For a general understanding of the environment for the system and method disclosed herein as well as the details for the system and method, reference is made to the drawings. In the drawings, like reference numerals have been used throughout to designate like elements. As used herein, the word "printer" encompasses any apparatus that produces ink images on media, such as a digital copier, bookmaking machine, facsimile machine, a multi-function machine, or the like. As used herein, the term "process direction" refers to a direction of travel of an image receiving surface, such as an imaging drum or print medium, and the term "cross-process direction" is a direction that is substantially perpendicular to the process direction along the surface of the image receiving surface. Also, the description presented below is directed to a system for operating inkjets in an inkjet printer to clear inoperative inkjets selectively while printing ink images. The reader should also appreciate that the principles set forth in this description are applicable to similar imaging devices that generate images with pixels of marking material.

Figure 3:
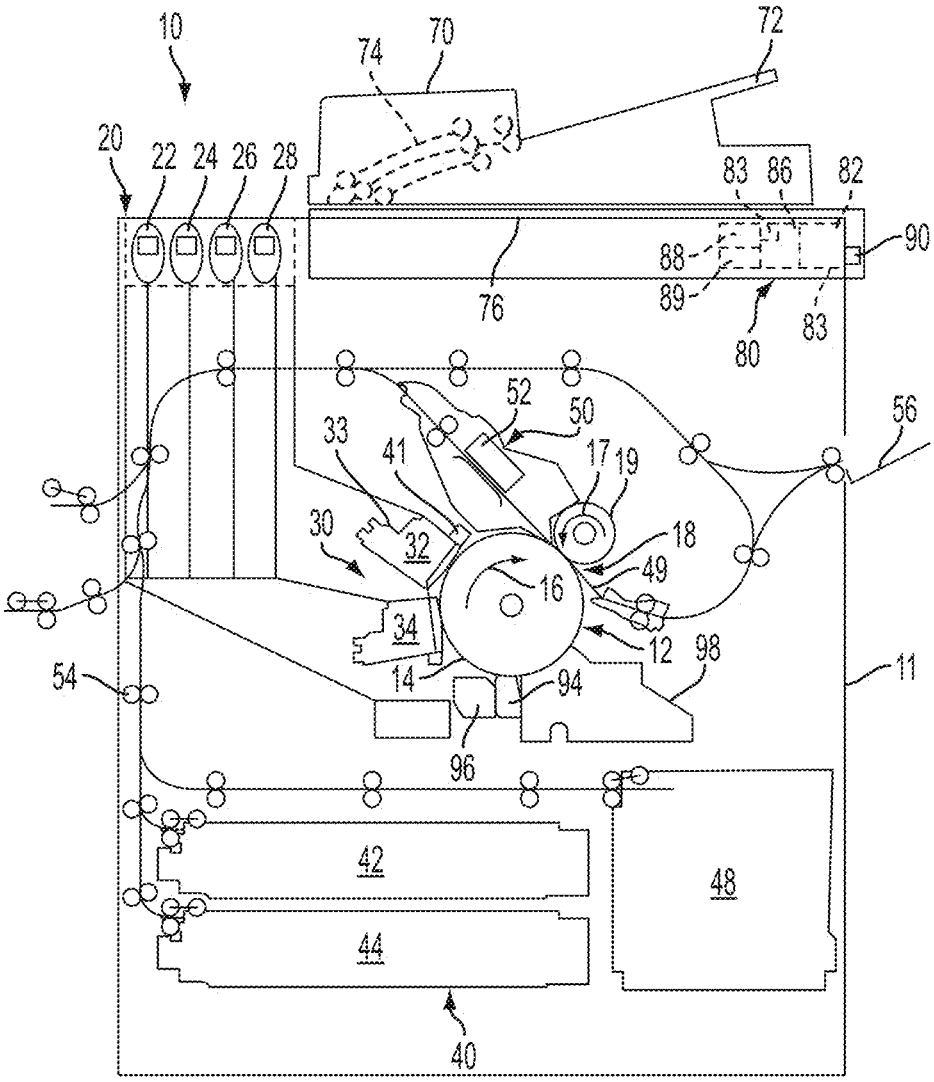
FIG. 3 PRIOR ART
FIG. 3 is a schematic diagram of a prior art printer in which the process of FIG. 2 can be implemented.

As shown in FIG. 3, a particular prior art printer 10 includes a frame 11 to which are mounted directly or indirectly all of the operating subsystems and components of the printer 10, as described below. The printer 10 further includes a rotating intermediate image receiving member 12 that has an imaging surface 14 movable in the direction 16, and on which phase change ink images are formed. A transfix roller 19 rotatable in the direction 17 is loaded against media and the surface 14 of image receiving member 12 to form a nip 18, within which ink images formed on the surface 14 are transfixed onto a heated media sheet 49.

The printer 10 also includes a phase change ink delivery system 20 that has at least one source 22 of one color phase change ink in solid form. The printer 10 shown is a multicolor image producing machine. The ink delivery system 20 includes four (4) sources 22, 24, 26, 28, representing four (4) different colors CMYK (cyan, magenta, yellow, black) of phase change inks. The ink delivery system 20 also includes a melting and control apparatus (not shown) for melting or phase changing the solid form of the phase change ink into a liquid form. The phase change ink delivery system is suitable for supplying the liquid ink to a printhead system 30 including at least one printhead assembly 32. The printer 10 shown is a wide format high-speed, or high throughput, multicolor image producing machine. The printhead system 30 includes multiple multicolor ink printhead assemblies 32, 34. In the embodiment illustrated, each printhead assembly includes a plurality of independent printheads.

As further shown, the printer 10 includes a substrate supply and handling system 40. The substrate supply and handling system 40, for example, can include sheet or substrate supply sources 42, 44, 48, of which supply source 48, for example, is a high capacity paper supply or feeder for storing and supplying image receiving substrates in the form of cut media sheets 49, for example. The substrate supply and handling system 40 also includes a substrate handling and treatment system 50 that has a substrate heater or pre-heater assembly 52. The substrate supply and handling system 40 further includes a media transport 54, such as media transport rollers, for moving media 49 through the printer 10 from the supply sources 42, 44, 48 to a discharge area 56. The printer 10 as shown can also include an original document feeder 70 that has a document holding tray 72, document sheet feeding and retrieval devices 74, and a document exposure and scanning system 76.

Operation and control of the various subsystems, components, and functions of the printer 10 are performed with the aid of a controller 80. The controller 80, for example, is a self-contained, dedicated minicomputer having a central processor unit (CPU) 82 with electronic storage 84, and a display or user interface (UI) 86. The controller 80, for example, includes a sensor input and control circuit 88 as well as a pixel placement and control circuit 89. In addition, the CPU 82 reads, captures, prepares, and manages the image data flow between image input sources, such as the scanning system 76, or an online or a work station connection 90, and the printhead assemblies 32, 34. As such, the controller 80 is the main multi-tasking processor for operating and controlling all of the other printer subsystems and functions.

The printer controller 80 further includes memory storage for data and programmed instructions. The controller 80 may be implemented with one or more general or specialized programmable processors that execute programmed instructions. The instructions and data required to perform the programmed functions can be stored in memory associated with the processors or controllers. The processors, their memories, and interface circuitry configure the controllers to perform the functions, such as the test pattern generation and the digital image analysis, described more fully below. These components can be provided on a printed circuit card or provided as a circuit in an application specific integrated circuit (ASIC). Each of the circuits can be implemented with a separate processor or multiple circuits may be implemented on the same processor. Alternatively, the circuits can be implemented with discrete components or circuits provided in VLSI circuits. Also, the circuits described herein can be implemented with any combination of processors, ASICs, discrete components, or VLSI circuits.

Figure 4:
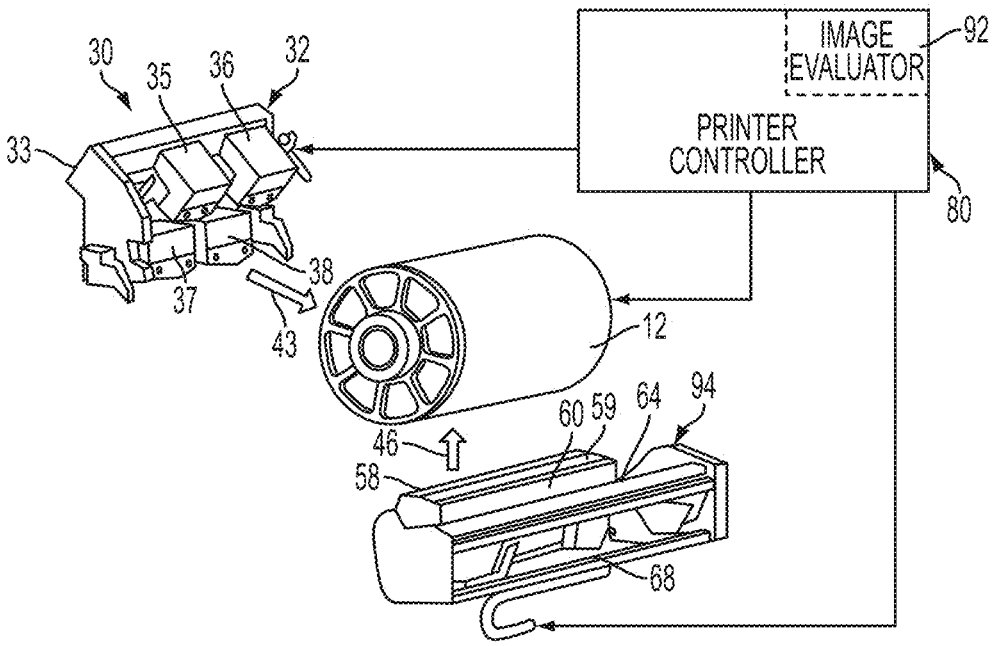
FIG. 4 PRIOR ART
FIG. 4 is a schematic diagram of a printhead assembly, image generator, and image evaluator used in the printer of FIG. 3.

Referring to FIG. 4, a schematic diagram of the components operated by the controller 80 to identify inoperative inkjets from a test pattern image on the surface of the image receiving member 12 is shown. The printhead assembly 32 includes four printheads 35, 36, 37, 38. Typically, each of these printheads ejects ink, indicated by arrow 43, to form an image on the image receiving member 12. The four printheads are arranged in a two by two matrix with the printheads in one row being staggered with reference to the printheads in the other row. Although the embodiment shown depicts a printhead assembly having four printheads, solid ink printers can have one or any number of any size printheads arranged in any practical manner.

Referring to FIGS. 3 and 4, the printheads 35, 36, 37, 38 of the printhead assembly 32 are operatively connected to a support member 33 to position the printheads across a width of the image receiving member 12 that extends in the cross-process direction. To permit movement of the printheads 35, 36, 37, 38 across the image receiving member 12, the printer 10 further includes an actuator (not shown), which is coupled to the support member 33. This actuator is configured to move the support member 33 transversely to the process direction to move the printheads in a cross-process direction across the width of the image receiving member 12.

The rotating image receiving member 12 can be a rotating drum, as shown in the figures, belt, or other substrate for receiving ink ejected from the printheads. The image is typically jetted onto a thin intermediate receiving surface, such as oil, which is maintained on the receiving member 12. Alternatively, the printheads can eject ink onto cut or continuous media 49 moving along a path adjacent to the printheads. To rotate or otherwise move the image receiving member 12, the printer 10 further includes another actuator (not shown), which is coupled to the image receiving member 12. Controlled firing of the inkjets in the printheads 35, 36, 37, 38 in synchronization with the rotation of the image receiving member 12 enables the formation of multiple vertical or partially encircling image bars across the width of the image receiving member 12. When occurring in synchronization with multiple consecutive rotations of the image receiving member 12, controlled firing of the inkjets and controlled actuation of the printhead assembly 32 in the cross-process direction enable a single inkjet to form an image over a portion of the image receiving member 12. The image corresponds to the printhead travel and is comprised of a series of closely spaced lines made up of closely spaced pixels. Similarly, controlled firing of the inkjets at a given frequency without actuation of the printhead assembly 32 enables a single inkjet to form a single continuous vertical bar extending in the process direction. The vertical line is typically formed in a single rotation of the image receiving member 12. Obviously, portions of an image may not include ink pixels, such as areas having no graphic or text content.

Referring still to FIGS. 3 and 4, the printer 10 also includes an image generator 94 to form a digital image of the ink image on the image receiving member 12. The image generator 94 can include a light source 58 for illuminating the image receiving member 12 and a plurality of electro-optical sensors 59. Each sensor 59 generates an electrical signal having an amplitude that corresponds to the intensity of the reflected light received by the sensor 59. These signals form the digital image of the ink image on the image receiving member 12. In one embodiment, the electro-optical sensors 59 are implemented in an integrated circuit. Each integrated circuit provides 432 electro-optical sensors 59. The image generator 94 has twelve integrated circuits that are linearly arranged in the cross-process direction to generate the digital image of the imaging member.

The light source 58 and electro-optical sensors 59 of the image generator 94 are operatively mounted to a support member 60. In one embodiment, the support member 60 is mounted on a bar 64 for reciprocating movement across the image receiving member 12 in the cross-process direction. In this embodiment, an actuator 68, such as an electrical motor, is coupled to the support member 60, through gear trains, translational, or rotational linkages or the like to move the first support member of the image generator 94 across the image receiving member 12 in response to a signal from the controller 80. The actuator 68 is configured to respond to signals from the controller 80. Although the support member 60 of this embodiment is configured for reciprocating movement across the image receiving member 12, other embodiments may use a fixed support member.

Referring to FIG. 4, the controller 80 is coupled to the printhead assembly 32, the image receiving member 12, and the image generator 94 to synchronize the operation of these subsystems. To generate an image, the controller renders a digital image stored in a memory of the printer and generates inkjet firing signals and printhead actuation profiles from the digital image. The firing signals are delivered to the printheads 35, 36, 37, 38 in the assembly 32 to operate the piezoelectric actuators of the inkjets in the printheads to eject ink selectively. The actuation profiles are delivered to the actuator coupled to the printhead assembly to control movement of the printhead assembly 32 in the cross-process direction. The controller 80 is coupled to the image receiving member 12 to control the rate and direction of rotation of the image receiving member 12. The controller 80 also generates signals to activate the image generator 94 for illumination of the image receiving member 12 and generation of a digital image that corresponds to the image on the member 12. The digital image is received by the controller 80 for storage and processing. A portion of the instructions executed by the controller 80 implement an image evaluator 92 that processes digital images of ink images or test patterns on the image receiving member 12 to detect weak and/or missing inkjets.

Figure 5:
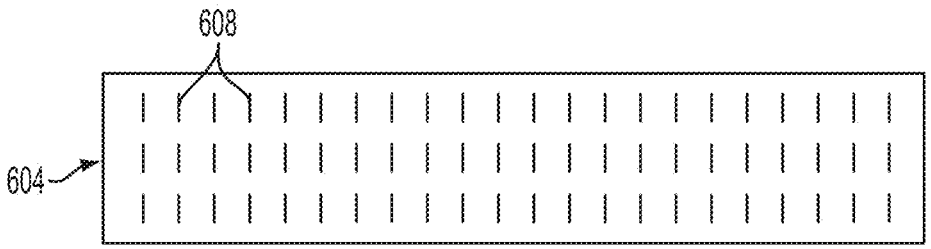
FIG. 5 PRIOR ART
FIG. 5 is a portion of a test pattern useful for detecting missing inkjets.

A process for detecting missing and/or weak inkjets in a digital image of a test pattern is now described with reference to FIG. 5, FIGS. 6A and 6B, and FIGS. 7A and 7B. FIG. 5 shows a portion of a test pattern useful for detecting missing and/or weak inkjets. The test pattern 604 is comprised of a series of vertical dashes 608. Each dash is generated by a single inkjet ejecting a series of ink drops as the image receiving member 12 is rotated past a printhead. Thus, the portion of the test pattern 604 shown in FIG. 5 is generated by twenty-two inkjets. The amount of ink in typical test patterns, such as test pattern 604, is deliberately kept small since the test pattern is wiped from the image receiving member 12 and the ink is collected by a drum maintenance unit (98, FIG. 3). Test patterns can be printed in areas intended for ink images on media or imaging members.

Figure 6A:
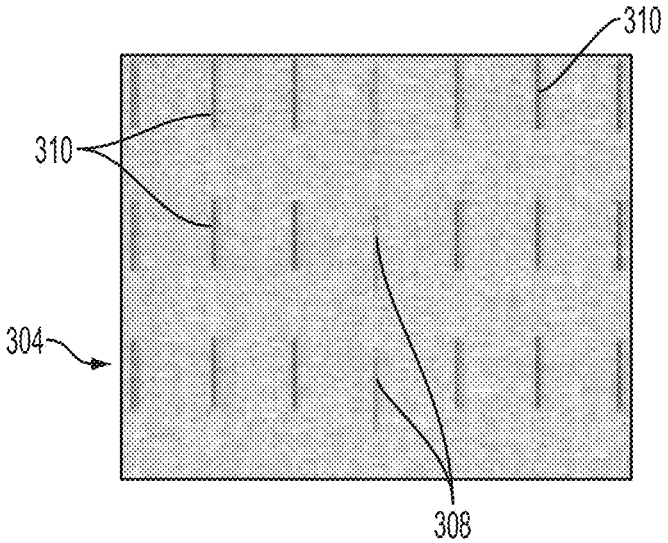
FIG. 6A is a portion of a digital image of a test pattern having evidence of a weak inkjet.
Figure 6B:
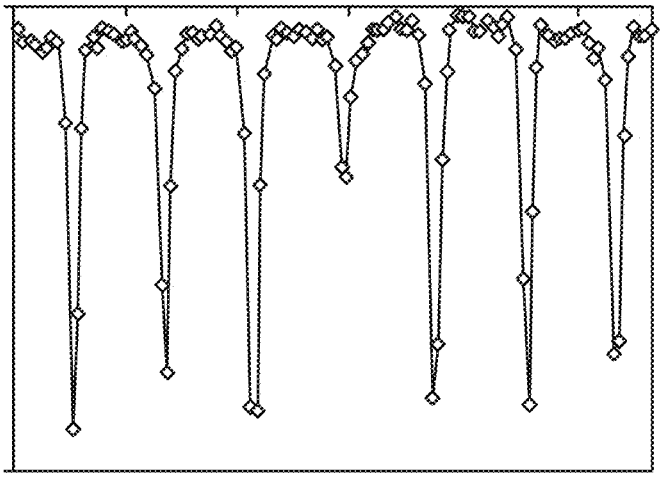
FIG. 6B is a profile of the data shown in the image of FIG. 6A.

In FIG. 6A, a portion of a test pattern 304 is shown with the dashes 308 in the pattern being generated by a weak inkjet. A "weak" inkjet is an inkjet that responds intermittently to a firing signal or that responds by ejecting ink drops having a mass that is less than a nominal ink drop mass corresponding to the characteristics of the firing signal for the inkjet. The ink in the dashes 308 causes the image generator 94 to generate an electrical signal that has an amplitude that is closer to the amplitude for the signals generated for the areas of the image receiving member that do not have ink on them than the amplitudes for the signals generated for the other dashes 310. The amplitude differences and similarities of a digital image across test pattern 304 are shown in FIG. 6B. The amplitude signal patterns depicted in the figures are examples and can look differently based on depiction parameters or other implementations. The portion of the test pattern 804 shown in FIG. 7A has area 808 being generated by a missing inkjet where little or no ink was ejected by the inkjet. A "missing" inkjet is an inkjet that does not eject an ink drop or that ejects an essentially imperceptible amount of ink in response to a firing signal. A digital image across test pattern 804 yields the amplitude profile shown in FIG. 7B. As further used herein, a "missing" inkjet is an inkjet that has one or more of the characteristics of "weak" or "missing" inkjets as described above. An inoperative inkjet, as noted above, includes inkjets that are either missing or weak. An operable inkjet is an inkjet that does not exhibit any of the characteristics of a missing inkjet as now defined.

Figure 7A:
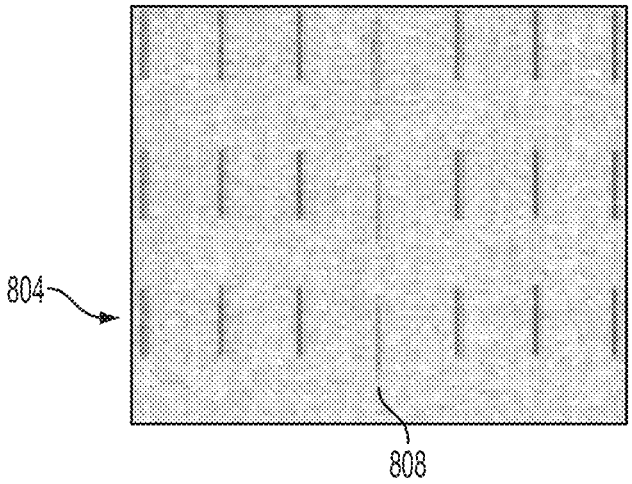
FIG. 7A is a portion of a digital image of a test pattern having evidence of a missing inkjet.
Figure 7B:
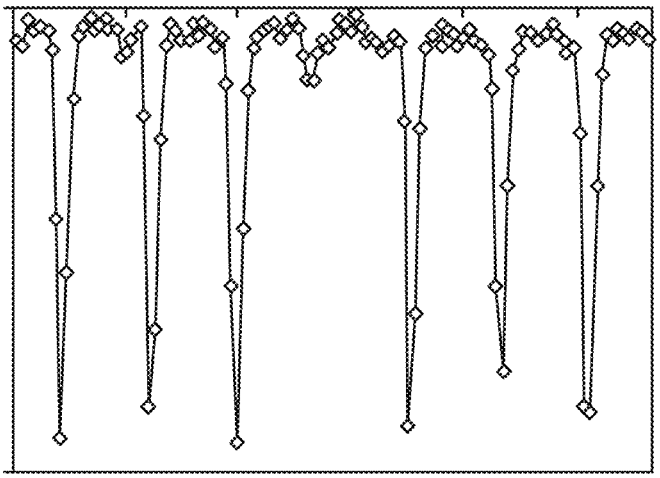
FIG. 7B is a profile of the data shown in the image of FIG. 7A.

The amplitude profiles generated by the image generator 94, such as those shown in FIGS. 6B and 7B, are used by the image evaluator 92 to detect missing inkjets. In one evaluation method, the amplitude of a profile curve for an inkjet is compared to a predetermined amplitude threshold to identify a missing inkjet from an image of an ink image or of a test pattern. In another evaluation method, an area under a profile curve for an inkjet is integrated and compared to a predetermined area threshold to identify a missing inkjet from a test pattern. In yet another evaluation method, the amplitudes of the profiles and the areas under the profile curves are computed and compared to predetermined thresholds. In this method, both the amplitude and integration result must be less than the predetermined thresholds before the inkjet is identified as being missing. Although the inkjet evaluation methods have been described with reference to amplitude and area comparisons, other evaluation methods and combinations of methods are possible. For example, known methods of inoperative inkjet detection include comparing image data of an ink image with the rendered image data used to print the ink image to detect inoperative inkjets.

In an embodiment of an improved inkjet printer, a firing signal waveform is used to operate inkjets detected to be inoperative to energize the actuator of an inkjet above levels encountered in printing ink images. This type of firing signal waveform is called a "clearing signal" in this document. A clearing signal is any electrical signal having waveform parameters that cause an inkjet actuator to extend a diaphragm further into an ink chamber than a firing signal configured for ink image printing. "Ink image printing" refers to the operation of inkjets in one or more printheads in accordance with image data that has been rendered, as that term is understood in the digital printing art, for the production of ink images on an image receiving surface. The additional energy resulting from the application of a clearing signal can be thought of as expelling ink more forcefully from the ink chamber to remove any debris and/or entrained air from the inkjet ejector. The waveform parameters that can be altered to form a clearing signal include the amplitude, slope, or duration of the signal or any combination of these parameters.

A firing signal for ink image printing and a clearing signal are shown in FIG. 1. In both waveforms, the voltage of the firing signal 402 increases at a first rate to a first inflection voltage 404, and then increases at a lower rate to a peak voltage $V_{pp}$ 408. The firing signal remains at the peak voltage for a predetermined time period before changing to a negative voltage with a negative voltage inflection voltage 406, and a negative peak voltage 410. In FIG. 1, the waveform for the peak voltage $V_{pp}$ and negative peak voltage $V_{ss}$ have substantially identical magnitudes and waveform shapes with different polarities. The change in voltage between $V_{pp}$ and $V_{ss}$ is referred to as a "peak-to-peak" portion of the electrical signal. After generating the $V_{ss}$ voltage for the predetermined time period, the waveform returns to zero voltage 428 and then drops a second time to an inflection point 432 and tail voltage $V_t$ 436. The magnitude of the tail voltage is less than the magnitude of the peak voltages $V_{pp}$ and $V_{ss}$ and the polarity of the tail voltage may be either positive or negative. In an exemplary embodiment, the magnitudes for $V_{pp}$ and $V_{ss}$ are in a range of approximately 30 to 50 volts and the magnitude of $V_t$ is between approximately 10 and 20 volts, although alternative ink ejector configurations operate with various voltage levels.

The clearing signal 414 has a similar shape as the firing signal 402, but is configured differently to generate more ejecting energy from an inkjet. In the example of a clearing signal 414, the clearing signal has both a greater amplitude and a longer duration for the peak-to-peak portion and the tail voltage as well as a steeper slope. In other embodiments, any one of the duration, slope, and amplitude can be adjusted in a manner that enables the inkjet ejector that receives the signal to generate more ejecting energy in an effort to clear the inkjet ejector of debris and/or air entrained in the ink and to restore the inkjet ejector to an operative state.

Figure 2:
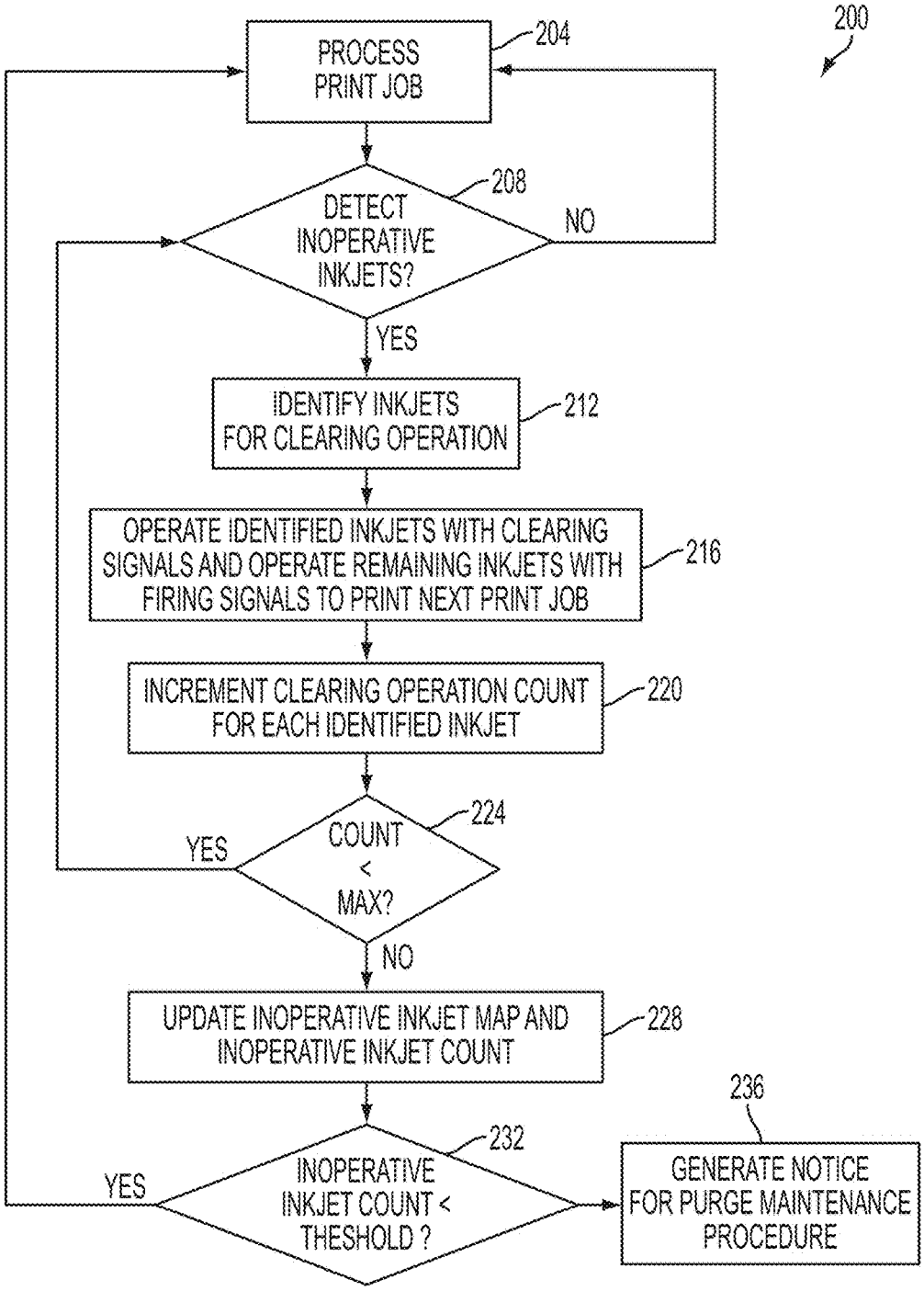
FIG. 2 is a flow diagram of a process for operating inoperative inkjets while printing to clear the inoperative inkjets.

A process for operating a printer to detect inoperative inkjets and use a clearing signal to restore such inkjets is shown in FIG. 2. The process 200 begins as the controller 80 that operates a printer processes print jobs (block 204). Processing print jobs refers to the controller operating a print engine to render image data and generating corresponding firing signals that are delivered to inkjet actuators within printheads to eject ink onto an image receiving surface to form an ink image. Image data of the ink images of the image receiving surface are generated by an optical sensor system, such as the image generator 94 described above. These data are processed in a known manner to detect inoperative inkjets (block 208). If no inoperative inkjets are detected, print jobs continue to be processed as they are received (block 204). If inoperative inkjets are detected, then the controller executing the programmed instructions that implement the process 200 identifies inkjets that can be operated with a clearing signal without adversely affecting an ink image (block 212). Although the ink drop ejected by an inkjet ejector receiving a clearing signal may be much larger, and in some cases, as large as five times the volume or mass of an ink drop ejected by an inkjet ejector receiving a firing signal, the larger drop may not adversely affect the quality of the ink image unless the number and/or spacing of the larger drops exceeds some empirically determined threshold. For example, in some embodiments, the minimum separation distance between the larger drops formed by clearing signals can correspond to the distance between drops ejected by inkjets that are no closer than five inkjets apart when the larger drops are printed at 300 dpi. In another embodiment, the number of inkjet ejectors that can be operated with a clearing signal can be limited to a predetermined number within a predetermined sized area. For example, a limit of three inkjet ejectors can be operated in a four square inch area in one embodiment. Limits of this type can also be established based on other criteria, such as image type, text or graphics, for example, or density or resolution of the image, photo mode, or draft mode, as another example. Note that all statements of the drop mass ejected when using a clearing signal relate to a drop mass expected from the inkjet if the inkjet was operable. The actual ink mass ejected may be any amount from zero to approximately the mass expected from the inkjet responding to the clearing signal.

After the inkjets are identified for operation with a clearing signal (block 212), the controller(s) configured to operate the corresponding printhead(s) in which the identified inkjets are located generate and deliver to the identified inkjets the clearing signal, while the remaining inkjets are operated with firing signals corresponding to rendered image data in the printer (block 216). The clearing signal excites or operates the actuator of the inkjet in a manner that attempts to normalize or improve the jetting effectiveness of the inkjet. Any specific attempt of the clearing signal to accomplish the clearing objective may or may not be successful in operating the actuator in the inkjet to eject a clearing volume of ink with the expected ink mass. Repetitive attempts can increase the clearing effectiveness in incremental fashion or one attempt may successfully restore normal function. The expected ink mass can be as little as twenty percent greater than the ink mass ejected by the inkjet in response to a nominal firing signal. A count of consecutive clearing signal operations of each identified inkjet is incremented (block 220) and the image data of the resulting ink image on the image receiving member are generated and analyzed (block 208), if the count is less than a predetermined maximum (block 224). For those inkjets having a counter that reaches the predetermined maximum, an inoperative inkjet map and accumulated inoperative inkjet count is updated (block 228). If the inoperative inkjet count is less than a predetermined threshold (block 232), the process continues by processing the next print job (block 204) and subsequent inoperative inkjet identification is made with regard to the inoperative inkjet map. That is, any inkjet identified as being inoperative with the processing in block 208 and as being included in the inoperative inkjet map is not identified as an inkjet to be operated with a clearing signal as the inkjet has failed to recover its ejecting ability after a predetermined number of attempts. If the accumulated number of inoperative inkjets failing to respond to the clearing signal reaches the predetermined maximum (block 232), then the controller determines a purge maintenance procedure is required and the controller generates a signal to notify an operator or user that the printer is being taken out of service for a purge maintenance procedure (block 236). Alternatively, the controller can be configured to notify the operator of the condition and receive a signal from a user interface that enables the controller to continue operation of the printer for continued printing.

In operation, a controller of a printer and the printhead controllers that generate firing signals are configured with programmed instructions and electronic components to implement the process 200. Thereafter, the controller executes the instructions during the processing of print jobs to detect inoperative inkjets. While continuing to process and print the print jobs, the controller identifies inoperative inkjets, operates the identified inkjets with clearing signals, and evaluates image data to determine whether the inkjets have been cleared. If the number of inoperative inkjets failing to respond to the clearing signal and recover their ejecting ability reaches the predetermined maximum, the controller notifies the operator a purge maintenance procedure is required. Processing of print jobs can be suspended until the purge maintenance procedure is performed. Thereafter, the controller returns the printer to operational mode for processing print jobs.

It will be appreciated that variants of the above-disclosed and other features, and functions, or alternatives thereof, may be desirably combined into many other different systems or applications. Various presently unforeseen or unanticipated alternatives, modifications, variations, or improvements therein may be subsequently made by those skilled in the art, which are also intended to be encompassed by the following claims.

What is claimed is:

1. A method for clearing an inkjet in a printhead of a printer during printing comprising:

delivering with a controller in the printer to a first inkjet in a plurality of inkjets in the printhead, each inkjet in the printhead having a piezoelectric actuator configured to eject an ink drop from a nozzle and pull ink from a manifold in the printhead, a first signal configured to operate the piezoelectric actuator in the first inkjet, the first signal being configured to eject an ink drop from the first inkjet that corresponds to a pixel of a digital image stored in a memory operatively connected to the controller in the printer;

delivering with the controller to at least one other inkjet in the printhead a second signal configured to operate the piezoelectric actuator in the at least one other inkjet, the second signal being different than the first signal, does not correspond to any pixel of the digital image stored in the memory, and being further configured to operate the piezoelectric actuator in the at least one other inkjet to extend a diaphragm further into an ink chamber of the at least one other inkjet than the diaphragm extends in response to a signal configured for ink image printing; and identifying the at least one other inkjet as an inoperable inkjet with the controller prior to delivery of the second signal, the second signal being an electrical signal configured to energize the piezoelectric actuator of the at least one other inkjet to a level sufficient to eject an ink drop from the at least one other inkjet that has at least twenty percent as much mass as an ink drop ejected from the at least one other inkjet for ink image printing.

2. The method of claim 1, the delivery of the second signal further comprising:

generating the second signal with the controller to have a voltage amplitude that is greater than a voltage amplitude of the first signal.

3. The method of claim 1, the delivery of the second signal further comprising:

generating the second signal with the controller to have a frequency that is greater than a frequency of the first signal.

4. The method of claim 1, the delivery of the second signal further comprising:

applying the second signal with the controller for a period of time that is greater than a period of time the first signal is applied to the first inkjet.

5. The method of claim 1, the delivery of the second signal further comprising:

generating the second signal with the controller to have a slope that is steeper than a slope of the first signal.

6. The method of claim 1 further comprising:

accumulating with the controller a count of a number of inoperable inkjets in the printhead;

selecting with the controller a predetermined number of the inoperable inkjets for delivery of the second signal in response to the accumulated count of inoperable inkjets exceeding a predetermined threshold; and delivering the second signal to the selected inoperable inkjets with the controller to operate the piezoelectric actuators of the selected inoperable inkjets with the second signal.

7. The method of claim 1 further comprising:

generating image data with an optical sensor of an area of the image receiving surface that received the ink drop ejected by the at least one other inkjet; and identifying with the controller a condition of the at least one other inkjet with reference to the image data of the image receiving surface area received from the optical sensor.

8. An apparatus for identifying a condition of an inkjet in a printhead comprising:

a printhead having a plurality of inkjets, each inkjet having a piezoelectric actuator configured to eject an ink drop from a nozzle and pull ink from a manifold in the printhead; and a controller configured to deliver to a first inkjet in the printhead a first signal configured to operate the piezoelectric actuator in the first inkjet, the first signal being configured to eject an ink drop from the first inkjet that corresponds to a pixel of a digital image stored in a memory operatively connected to the controller and to deliver to at least one other inkjet in the printhead a second signal configured to operate the piezoelectric actuator in the at least one other inkjet, the second signal being different than the first signal, does not correspond to any pixel of the digital image stored in the memory, and is further configured to operate the piezoelectric actuator to extend a diaphragm further into an ink chamber of the at least one other inkjet than the diaphragm extends in response to a signal configured for ink image printing and to identify the at least one other inkjet as an inoperable inkjet prior to delivery of the second signal, the second signal being an electrical signal configured to eject an ink drop from the at least one other inkjet that has at least twenty percent as much mass as the ink drop ejected from the first inkjet.

9. The apparatus of claim 8, the controller being further configured to generate the second signal to have a voltage amplitude that is greater than a voltage amplitude of the first signal.

10. The apparatus of claim 8, the controller being further configured to generate the second signal to have a frequency that is greater than a frequency of the first signal.

11. The apparatus of claim 8, the controller being further configured to apply the second signal for a period of time that is greater than a period of time the first signal is applied to the first inkjet.

12. The apparatus of claim 8, the controller being further configured to generate the second signal with a slope that is steeper than a slope of the first signal.

13. The apparatus of claim 8, the controller being further configured to accumulate a count of a number of inoperable inkjets in the printhead, select a predetermined number of the inoperable inkjets for delivery of the second signal in response to the accumulated count of inoperable inkjets exceeding a predetermined threshold, and deliver the second signal to the selected inoperable inkjets to operate the piezoelectric actuators of the selected inoperable inkjets with the second signal.

14. The apparatus of claim 8 further comprising:

an optical sensor configured to generate image data of an area of the image receiving surface that received the ink drop ejected by the at least one other inkjet; and the controller being further configured to identify a condition of the at least one other inkjet with reference to the image data of the image receiving surface area.

* * * * *